United States Patent [19]

Pease

[11] Patent Number: 4,928,056

[45] Date of Patent: May 22, 1990

[54] STABILIZED LOW DROPOUT VOLTAGE REGULATOR CIRCUIT

[75] Inventor: Robert A. Pease, San Francisco, Calif.

[73] Assignee: National Semiconductor Corporation, Santa Clara, Calif.

[21] Appl. No.: 255,673

[22] Filed: Oct. 6, 1988

[51] Int. Cl.[5] ..... G05F 3/24

[52] U.S. Cl. ..... 323/314; 323/316; 307/296.1; 307/296.6; 307/296.8

[58] Field of Search ..... 323/313–316, 323/224, 281; 307/296.1, 296.6, 296.8

[56] References Cited

U.S. PATENT DOCUMENTS 4,075,546 2/1978 Barber ..... 323/224
4,743,833 5/1988 Johnson ..... 323/281 X

OTHER PUBLICATIONS

"New Developments in IC Voltage Regultors", R. Widlar, IEEE Journal of Solid State Circuits, vol. SC6, No. 1, Feb. 1971, pp. 2–7.

*Primary Examiner*—Patrick R. Salce
*Assistant Examiner*—Emanuel Todd Voetlz
*Attorney, Agent, or Firm*—Gail W. Woodward; Lee Patch; Michael A. Glenn

[57] ABSTRACT

A voltage regulator circuit is set forth in which the series pass transistor has its high impedance (collector/drain) electrode connected to the output terminal and a shunt transistor has its low impedance (emitter/source) electrode connected to the output terminal. The circuit is arranged to ensure that the shunt transistor is always conductive so that its low impedance electrode will stabilize the operation of the circuit without requiring any external components. The circuit can be fabricated in either bipolar or CMOS form and a low dropout configuration is employed.

5 Claims, 1 Drawing Sheet

STABILIZED LOW DROPOUT VOLTAGE REGULATOR CIRCUIT

BACKGROUND OF THE INVENTION

The invention relates to voltage regulators and, in particular, to three-terminal voltage regulators. These devices respond to an unregulated input voltage and provide an output voltage that does not vary significantly in response to load variations or to input voltage variations. The devices also employ circuits that provide a substantially constant output voltage over a wide temperature range.

It is well known that voltage regulators have the best dynamio stability when their outputs are taken from the emitter of the power transistor. For example, the industry standard, LM117 series and the LM140 series devices, are relatively stable without external components. Conversely, when the output is taken from the collector of the power transistor, as is the case for the industry standard LM120 series and the LM137 series devices, a relatively large capacitor must be connected to the output terminal if stability is desired. The LM120 and LM137 specifications call for an output capacitor of at least one microfarad if tantalum and 10–25 microfarads if aluminum. Higher values are preferred.

While the above-mentioned devices are all of bipolar transistor construction, the same considerations apply to metal oxide semiconductor (MOS) construction. In particular, useful voltage regulators are being constructed using complementary MOS (CMOS) devices. In CMOS the above remarks apply to the sources and drains of the power transistors. When the source of the power transistor provides the output the circuits are relatively stable. However, when the output is taken from the power transistor drain a large output capacitor must be employed.

The reason for the above-expressed instability is understood to be due to the feedback loop gain. In a voltage regulator the power transistor is a part of a high gain negative feedback loop that is referenced to a constant voltage. When the power transistor emitter/-source electrode provides the output its voltage gain is less than unity and the circuit tends to be stable. When the output is taken from the collector/drain the voltage gain depends upon the load impedance and can be substantial. A large output capacitor is thus required for limiting the a-c gain so that stability is achieved.

In the following discussions bipolar transistor emitters and MOS transistor sources are referred to as the low impedance electrodes. The bipolar transistor collectors and MOS transistor drains are referred to as the high impedance electrodes These characterizations provide the functional device equivalents. The bipolar transistor bases and MOS transistor gates are referred to as control electrodes because they are also functionally equivalent.

Another power supply characteristic is its dropout voltage. This is defined as the input-output voltage differential at which the circuit ceases to regulate against further reductions in input voltage. As a practical matter, low dropout voltage is a virtue and is regarded as important in battery operated applications. Typically, the dropout voltage is on the order of 2 volts for the above-referenced devices and is inversely related to temperature. All of the above-designated device families employ a Darlington connected power output or pass transistor. This means that the Darlington input transistor base must be at least two x $V_{BE}$ above the emitter and the collectors must be at least a $V_{SAT}$ above this. However, the LM120 needs $V_{BE}$ + $V_{SAT}$. At the lower operating temperatures this is typically a voltage drop of about 2 volts. This voltage drop is sometimes called 'headroom' because the voltage regulator input must be high enough so that it will accommodate the output voltage plus the dropout voltage.

Examples of low dropout regulators are the LM2930 and LM2931 series devices. These are respectively rated at 150ma and 100ma and both have a dropout rating of less than 0.6 volt at rated current. Because their outputs are taken at the collector of a PNP transistor, they both require capacitors at their output terminals. The minimum capacitor values are specified at 10 and 22 microfarads respectively.

SUMMARY OF THE INVENTION

It is an object of the invention to increase the stability of low dropout voltage regulators.

It is a further object of the invention to employ a pass transistor in a voltage regulator in which the transistor high impedance terminal is connected to the regulator output and in which a transistor low impedance terminal is also connected to the output terminal for stability.

These objects are achieved in the following manner. In a voltage regulator circuit the pass transistor has its low impedance electrode (the emitter/source) connected to the positive input terminal and the high impedance electrode (the collector/drain) associated with the output terminal. Typically, this transistor is a bipolar PNP or a P channel MOS transistor. The control electrode (base/gate) is operated at a potential below the supply input voltage so that the pass transistor is turned on. This connection provides the lowest dropout voltage, but without any other stabilization typically requires a large output capacitor. To provide the desired stabilization a second or shunt transistor is provided with its low impedance electrode (emitter/-source) associated with the regulator output terminal and its high impedance (collector/drain) associated with the regulator return terminal. The shunt transistor is made a part of the voltage regulator negative feedback loop and means are provided to make sure that it is conductive for all operating conditions. The voltage regulator circuit includes a temperature stable reference voltage generator coupled to drive a first operational amplifier (op-amp) which in turn is coupled to the control electrode (base/gate) of the shunt transistor. A resistor is coupled in series with the high impedance (collector/drain) electrode of the shunt transistor and to a second op-amp that has an input offset voltage. The output of this second op-amp is coupled to the control (base/gate) electrode of the pass transistor. Thus, the voltage regulator includes a high gain feedback loop having the reference generator amplifier, the shunt transistor, the two op-amps and the pass transistor. Since the resistor in series with the shunt transistor is coupled to the input of the second op-amp the voltage across it must equal the offset voltage of the second op-amp. Thus, a feedback loop within the overall feedback loop is in operation. This secondary feedback loop ensures that the shunt transistor is always turned on and its low impedance (emitter/source) electrode will act to stabilize the voltage regulator. Since the pass transistor involves only a single transistor the dropout voltage is minimized.

DESCRIPTION OF THE INVENTION

It is to be understood that while the following description is directed to a CMOS structure the invention also applies to bipolar transistor circuits. For example, where a P channel transistor is shown, a PNP bipolar transistor could be substituted and where an N channel transistor is shown, an NPN bipolar transistor could be substituted. Where this is done, the bipolar transistor collector substitutes for the MOS transistor drain, the emitter substitutes for the source, and the base substitutes for the gate. Conventional CMOS fabrication is intended for the preferred embodiment. For equivalent bipolar construction, conventional monolithic, epitaxial, PN junction isolated processing is preferred. Furthermore, while the CMOS circuit shown is related to N well CMOS, the various components could be fabricated as P well devices. In this latter case, all transistor elements shown could be complemented and the power supply polarities reversed.

Figure 1:
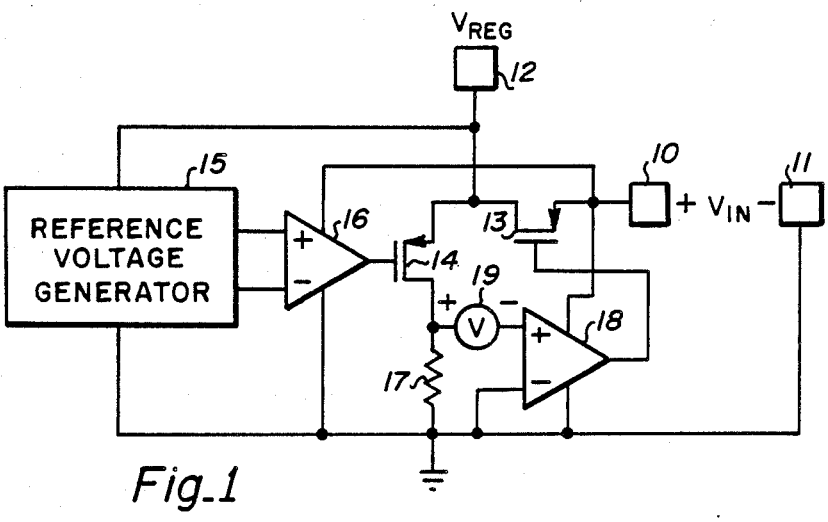
FIG. 1 is a block-schematic diagram of the circuit of the invention.

In FIG. 1 the essential elements are set forth in block-schematic diagram form. The power supply input is connected + to terminal 10 and − to ground terminal 11. The regulated output appears at terminal 12. Series pass P channel transistor 13 is connected between terminals 10 and 12. Since the source of transistor 13 is connected to terminal 10, its gate will be operated at a lower potential and the regulator dropout potential will be minimized. In the circuit shown, the dropout potential can be made as small as a fraction of a volt. However, the drain of transistor 13 is connected to output terminal 12 and, by itself, this configuration is unstable. Accordingly, some form of stabilization is desired. Shunt P channel transistor 14 has its source connected to output terminal 12 and its drain returned to ground. Since the source of transistor 14 is its low impedance electrode, it will act to stabilize the circuit. Obviously, transistors 13 and 14 could be replaced with bipolar PNP transistors where the emitters are connected in place of the sources and the collectors connected in place of the drains.

Voltage reference generator 15 develops a temperature stable band gap reference voltage and contains a voltage divider which responds to a regulated voltage at terminal 12. Reference voltage generator 15 drives op-amp 16 which in turn drives the gate of transistor 14. Resistor 17 returns the drain of transistor 14 to ground so that transistor 14 can act as a common source amplifier. Op-amp 18 is directly coupled to resistor 17 by way of an internally developed offset voltage source 19. The offset polarity is such that when the input terminals of op-amp 18 are at the same potential the offset voltage appears across resistor 17 as a small positive potential at the drain of transistor 14. The output of op-amp 18 drives the gate of transistor 13 which in turn provides all of the current that is required by any load (not shown) connected to terminal 12. In addition, transistor 13 also provides any current flowing in transistor 14 plus the quiescent current drawn by reference voltage generator 15. The action of the circuitry sets the potential at terminal 12 at the desired value. Thus, the components of FIG. 1 form an overall negative feedback loop around terminal 12 which drives it to a constant voltage level at which the input terminals of op-amp 16 are at the same potential.

The conduction in transistor 14 is maintained by means of a negative feedback loop within a negative feedback loop. Op-amp 18 in conjunction with transistor 13, operating as a common source amplifier, sets the conduction in transistor 14 so that the voltage drop across resistor 17 is exactly equal to the offset of op-amp 18. This feedback loop around the drain of transistor 14 involves one inversion and is therefore negative.

The overall voltage regulator feedback loop around terminal 12 involves reference voltage generator 15, op-amp 16, shunt transistor 14, op-amp 18, and series pass transistor 13. This loop involves three inversions (one each in op-amp 16, transistor 14 and transistor 13) so that it is negative and referenced to the bandgap of silicon. In the example to be given below the silicon bandgap reference voltage is 1.2 volts, $V_{REG}$ is 2.5 volts and $V_{IN}$ is operative down to 2.6 volts. This means that the dropout voltage is 0.1 volt at no load.

Figure 2:
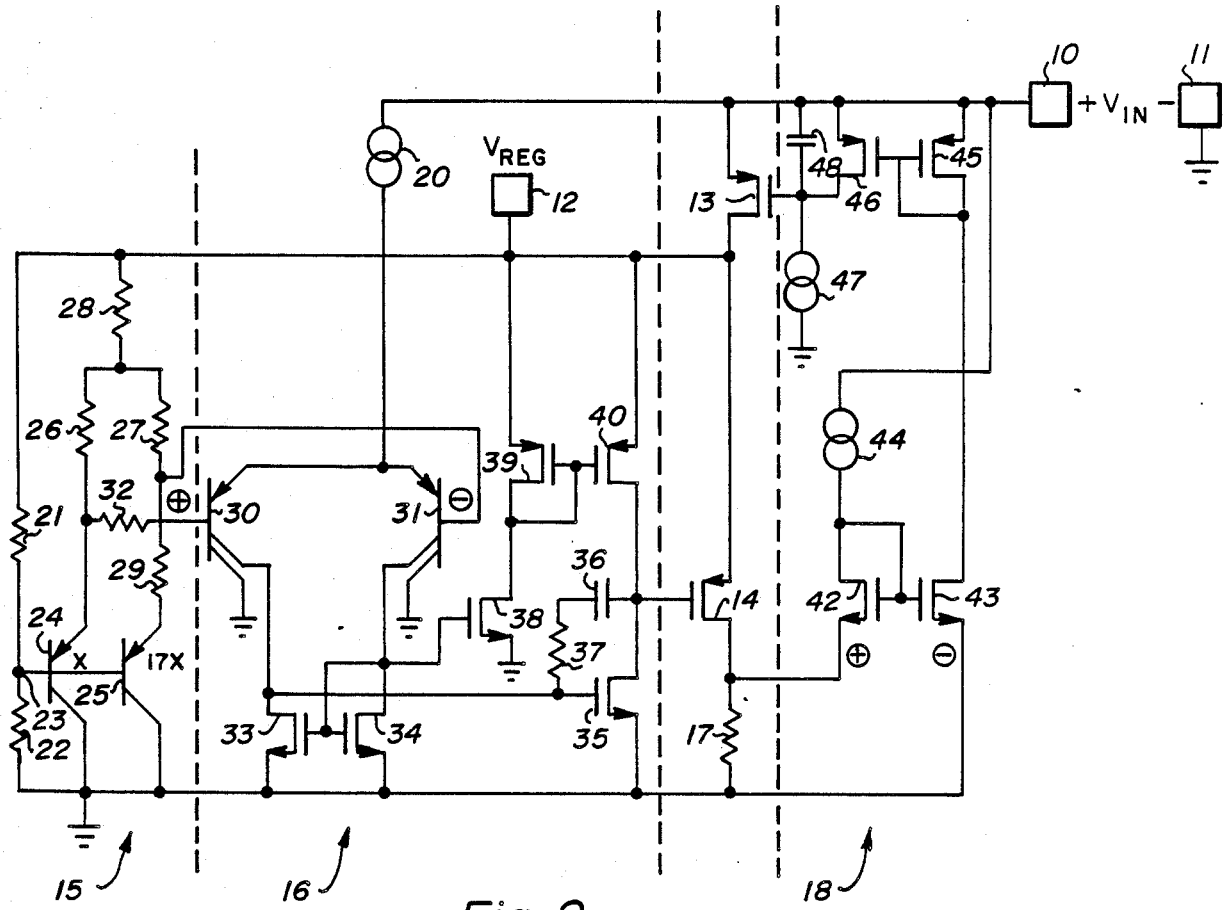
FIG. 2 is a detailed schematic diagram of the circuit of the invention.

FIG. 2 is a schematic diagram of a CMOS voltage regulator. The elements are of the kind found in N well CMOS wherein all of the P channel transistors are fabricated into PN junction isolated N wells located in a P type silicon substrate. All of the N channel devices are commonly fabricated into the P type substrate and therefore have back gate connections (not shown) to the negative power supply input terminal 11. Where the various elements relate to FIG. 1, the same designations are used.

Bipolar transistors 24 and 25 are those elements that are ordinarily parasitic to the CMOS devices. In such a PNP transistor, the base is an N well and the collector is dedicated to the substrate which is at the negative supply potential. The emitter is composed of a P channel transistor source or drain. Such parasitic transistors have relatively large current gain characteristics. Since the collectors are dedicated to the substrate such transistors must be operated in the common collector configuration.

Reference voltage generator 15 is coupled to output terminal 12 and includes a voltage divider along with a bandgap reference circuit. Resistors 21 and 22 form a voltage divider connected between terminal 12 and ground (terminal 11). Collector dedicated parasitic PNP transistors 24 and 25 have their bases returned to node 23. Resistors 26–29 return the emitters of transistors 24 and 25 to terminal 12. Transistors 24 and 25 are current density ratioed so that transistor 24 is operated at a higher current density than transistor 25. This is most simply done by making transistor 25 n times larger than transistor 24 and operating them at the same emitter current by matching resistors 26 and 27. Alternatively, transistors 24 and 25 can be matched and operated at different currents. This would be done by ratioing resistors 26 and 27. Also, transistors 24 and 25 can be ratioed along with employing ratioed currents. The resulting $\Delta V_{BE}$ appears across resistor 29. This value is in accord with the relationship:

$$\Delta V_{BE} = \frac{kT}{q} \ln \frac{J24}{J25}$$

where:

k is Boltzmann's constant q is the charge of an electron

J24 J25 is the current density ratio in transistors 24 and 25. $\Delta V_{BE}$ is proportional to absolute temperature (PTAT) and goes to zero at absolute zero. At 300° K. and with transistor 25 operating at eight times the current density of transistor 24, $\Delta V_{BE}$ will be about 54 millivolts which is determined entirely by physical characteristics. It has a temperature coefficient of about 0.33%/° C. degree.

As pointed out above the bipolar parasitic transistors have their collectors dedicated to the substrate and must be operated in the common collector configuration. However, it has been discovered that a non-dedicated collector can be formed either adjacent to or surrounding an emitter. Such a non-dedicated collector can be used as a separate transistor, but it operates in parallel with a dedicated collector transistor. This concept is set forth in U.S. Pat. No. 4,602,168, by Peter S. Single and titled LOW OFFSET MOS COMPARATOR CIRCUIT. While a P well CMOS structure is shown to yield NPN transistors having non-dedicated collectors, the use of an N well process to yield equivalent PNP transistors is obvious. The teaching in the Single patent is incorporated herein by reference.

PNP transistors 30 and 31 are each of the kind described above where a substrate dedicated collector is mated with a lateral collector. The two emitters are coupled together through a constant tail current source 20 to input supply terminal 10. Transistors 30 and 31 are driven from resistors 26 and 27. Resistor 32 provides the coupling to transistor 30. The lateral collectors of transistors 30 and 31 are connected to an N channel transistor current mirror load composed of N channel transistors 33 and 34. The drain of transistor 34 is connected to the gates of transistors 33 and 34. The drain of transistor 33 drives the gate of N channel transistor 35 which acts as a high gain inverter. Capacitor 36 and resistor 37 provide conventional frequency compensation of op-amp 16. The drain of transistor 34 is coupled to the gate of N channel transistor 38 which is also a high gain inverter that has a current mirror load composed of P channel transistors 39 and 40. Thus, transistors 35 and 40 are driven in paraphase and their drains comprise the output node of op-amp 16. This node is directly connected to the gate of P channel shunt transistor 14.

The drain of transistor 14 is returned to ground through resistor 17 and is connected to the source of N channel transistor 42. The drain of transistor 42 is returned to its gate and to the gate of transistor 43 which forms a current mirror therewith. Current source 44 passes a relatively small current, about one microampere, through transistor 42 and this current is mirrored in transistor 43. These two transistors comprise the differential input devices of op-amp 18. Note that transistor 43 has its source grounded to form an inverting input as noted. The source of transistor 42 is operated at the voltage drop across resistor 17 above ground. This differential represents the offset potential of op-amp 18 (shown as voltage source 19 of FIG. 1). This offset voltage source is produced by ratioing the sizes of transistors 42 and 43 and it is enhanced by reducing the current in source 44 to a level at which transistors 42 and 43 are "starved".

The drain of transistor 43 is connected to the gate and drain of P channel transistor 45 which is connected to the gate of P channel transistor 46 to form a current mirror. Thus, transistor 46 comprises the output node of op-amp 18. Current sink 47 acts as a pull down element for the output node which is directly connected to the gate of P channel series pass transistor 13. Capacitor 48 provides frequency compensation for op-amp 18.

In operation transistor 13 will drive terminal 12 to a voltage at which the bases of transistors 30 and 31 are at the same potential. For this condition the currents flowing in resistors 26 and 27 are controlled. If resistors 26 and 27 are matched the currents in transistors 24 and 25 will be equal. Under this condition $\Delta V_{BE}$ appears across resistor 29. This operation results from a major or overall negative feedback loop.

While transistor 13 sources current to output terminal 12, reference voltage generator 15, and transistors 39 and 40, as quiescent current it also sources current to P channel shunt transistor 14. In the example to be given below, resistor 17 is 1000 ohms and transistor 14 operates at 100 microamperes. This means that the transistor 42–43 offset is 0.1 volt. Op-amp 18 will drive transistor 13 to source 100 microamperes into transistor 14 to create a secondary negative feedback loop (within the major negative feedback loop) that responds to the physically created offset.

In addition, transistor 13 will source whatever current (within reason) that is flowing in any load element (not shown) that is connected to terminal 12. Thus, a regulated output voltage is developed at the output terminal 12 which is also connected to a low impedance device electrode in the form of the source of transistor 14. This stabilizes the voltage regulator without requiring a large filter capacitor in a circuit in which the pass transistor high impedance electrode is connected to the output terminal. As pointed out above, the dropout voltage is also very low. It should be pointed out that while the circuit can source current at terminal 12 the presence of transistor 14 makes the circuit capable of sinking current into terminal 12. This feature is useful where the regulator is to be connected to circuits that may operate at a voltage higher than $V_{REG}$.

EXAMPLE

The circuit of FIG. 2 was implemented in N well CMOS using the following components:

| COMPONENT | VALUE |
|---|---|
| Resistor 17 | 1K ohms |
| Current Source 20 | 40 microamperes |
| Resistor 21 | 24.394K ohms |
| Resistor 22 | 25.105K ohms |
| Resistors 26 and 27 | 28.505K ohms |
| Resistor 28 | 15.232K ohms |
| Resistor 29 | 5.131K ohms |
| Resistor 32 | 3.95K ohms |
| Capacitor 36 | 5 picofarads |
| Resistor 37 | 3.9K ohms |
| Current sources 44 and 47 | 1 microampere |
| Capacitor 48 | 8 picofarads |
| RAP 30i × 88 | |

The following transistor width/length dimensions were employed:

| TRANSISTOR | W/L (MICRONS) |
|---|---|
| 13 | 300/3 |
| 14 | 200/2 |
| 33, 34, 35, 38 | 80/10 |
| 39, 40, 45, 46 | 20/20 |
| 42 | 30/20 |
| 43 | 10/20 |

Transistors 24 and 25 were operated at a current density ratio of 8:1. The voltage at terminal 12 was 2.5 volts and the circuit could provide 4 mA of output current @Vs = + 5.0 V. The circuit functioned well over the input range of 2.6 to 8.0 volts. The voltage at node 23 was 1.3 volts. The voltage across resistor 17 was 100 millivolts. The quiescent current with a 5-volt input supply was 0.22 mA.

The invention has been described and a working example detailed. When a person skilled in the art reads the foregoing description, alternatives and equivalents, within the spirit and intent of the invention, will be apparent. For example while the preferred embodiment employs N well CMOS construction, P well CMOS or bipolar construction could be employed. Therefore, it is intended that the scope of the invention be limited only by the following claims.

I claim:

1. A voltage regulator circuit having an unregulated input supply terminal, a regulated output supply terminal and a supply return terminal, said circuit being composed of transistors each one having controlled current flow electrodes of high and low impedance and a current flow control electrode, said circuit comprising:

a series pass transistor having its low impedance electrode connected to said unregulated input supply terminal, its high impedance electrode connected to said regulated output supply terminal and a control electrode;

means driven from said regulated output supply terminal and connected to said control electrode of said series pass transistor thereby creating an overall negative feedback loop that operates to develop a control potential that holds said regulated output supply terminal at a constant potential level that is substantially independent of temperature, input supply voltage and output supply terminal current;

a shunt transistor having its low impedance electrode connected to said regulated supply output terminal, means for returning its high impedance electrode to said supply return terminal and a control electrode; and means, responsive to the current flowing in said shunt transistor, connected to said control electrode of said series pass transistor to form an internal negative feedback loop, within said overall negative feedback loop, said internal negative feedback loop being operative to hold the current flow in said shunt transistor constant and said regulator circuit is thereby stabilized.

2. The voltage regulator circuit of claim 1 wherein said means for returning said high impedance electrode of said shunt transistor to said supply return terminal comprises:

a series resistor coupled between said high impedance electrode of said shunt transistor and said supply return terminal and connected to the input terminals of an operational amplifier having an output terminal connected to said control electrode of said series pass transistor.

3. The voltage regulator circuit of claim 2 wherein said operational amplifier includes means for developing an input offset potential whereby said offset potential appears across said series resistor and thereby determines the conduction in said shunt transistor.

4. The voltage regulator circuit of claim 1 wherein said circuit is fabricated using CMOS construction, said series pass transistor is a P channel transistor having its drain connected to said regulated output supply terminal and said shunt transistor is a P channel transistor having its source connected to said regulated output supply terminal.

5. The voltage regulator circuit of claim 1 wherein said circuit is fabricated using bipolar transistor construction, said series pass transistor is a PNP transistor having its collector connected to said regulated output supply terminal and said shunt transistor is a PNP transistor having its emitter connected to said regulated output supply terminal.

* * * * *